US011746779B2

(12) United States Patent
Yang et al.

(10) Patent No.: US 11,746,779 B2
(45) Date of Patent: Sep. 5, 2023

(54) SCROLL ASSEMBLY AND SCROLL COMPRESSOR

(71) Applicant: Danfoss (Tianjin) Ltd., Tianjin (CN)

(72) Inventors: Zhuangzhi Yang, Nordborg (DK); Xiaoping Zhang, Nordborg (DK); Zhi Li, Nordborg (DK)

(73) Assignee: Danfoss (Tianjin) Ltd., Tianjin (CN)

( * ) Notice: Subject to any disclaimer, the term of this patent is extended or adjusted under 35 U.S.C. 154(b) by 0 days.

(21) Appl. No.: 17/899,838

(22) Filed: Aug. 31, 2022

(65) Prior Publication Data

US 2023/0063530 A1 Mar. 2, 2023

(30) Foreign Application Priority Data

Sep. 2, 2021 (CN) ..... 202122112385.9

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/00*** | (2006.01) |
| ***F04C 2/04*** | (2006.01) |
| ***F04C 15/00*** | (2006.01) |

(Continued)

(52) U.S. Cl.

CPC ..... *F04C 2/04* (2013.01); *F04C 15/00* (2013.01); *F04C 18/0215* (2013.01); *F04C 23/008* (2013.01); *F04C 2230/10* (2013.01)

(58) Field of Classification Search

CPC .. F04C 2/025; F04C 18/0215; F04C 18/0246; F04C 18/0253; F04C 15/00; F04C 23/008; F04C 2230/10; F01C 17/06; F01C 17/063; F01C 17/066; F16D 3/00; F16D 3/02; F16D 3/04

See application file for complete search history.

(56) References Cited

U.S. PATENT DOCUMENTS 5,275,543 A * 1/1994 Tanaka ..... F01C 17/066 418/55.3
5,580,230 A * 12/1996 Keifer ..... F04C 18/0215 418/55.5
2020/0208632 A1* 7/2020 Nagulpelli ..... F01C 17/066

(Continued)

FOREIGN PATENT DOCUMENTS

CN 209083568 U 7/2019
CN 212928177 U 4/2021

(Continued)

*Primary Examiner* — Theresa Trieu
(74) *Attorney, Agent, or Firm* — McCormick, Paulding & Huber PLLC

(57) ABSTRACT

A scroll assembly includes an orbiting scroll and a cross ring. The orbiting scroll is configured to have a bottom plate. A plurality of bayonets and two positioning slots are provided on the outer peripheral surface of the bottom plate. The bayonets are adapted to be clamped by a chuck of a turning tool. The cross ring is configured to have an annular body and two positioning pins. An annular groove adapted for being formed by turning is provided on the lower surface of the bottom plate of the orbiting scroll, and a chamfer is formed on the edge of the annular groove formed by the intersection of the circumferential vertical surface of the positioning groove and the lower surface of the bottom plate.

13 Claims, 6 Drawing Sheets

(51) Int. Cl.
*F04C 18/02* (2006.01)
*F04C 23/00* (2006.01)

(56) References Cited

U.S. PATENT DOCUMENTS

| | | | | |
|---|---|---|---|---|
| 2020/0263544 | A1* | 8/2020 | Park | F01C 17/066 |
| 2021/0115923 | A1* | 4/2021 | Jo | F04C 18/0215 |

FOREIGN PATENT DOCUMENTS

| | | | | |
|---|---|---|---|---|
| CN | 113202748 | A | 8/2021 | |
| JP | H06712 | A | 1/1994 | |
| JP | H087041 | Y2 * | 2/1996 | F01C 17/066 |
| JP | H0885046 | A | 4/1996 | |
| JP | 2001227477 | A | 8/2001 | |
| JP | 2004019545 | A * | 1/2004 | F01C 17/066 |
| JP | 3669722 | B2 | 7/2005 | |
| KR | 1020050027400 | A | 3/2005 | |

* cited by examiner

SCROLL ASSEMBLY AND SCROLL COMPRESSOR

CROSS-REFERENCE TO RELATED APPLICATION

This application claims foreign priority benefits under U.S.C. § 119 from Chinese Patent Application No. 202122112385.9 filed Sep. 2, 2021, the content of which is hereby incorporated by reference in its entirety.

TECHNICAL FIELD

The present disclosure relates to a scroll assembly and a scroll compressor using the scroll assembly.

BACKGROUND

In the machining industry, it is often necessary to set a chamfer at the corner of a workpiece in order to avoid assembly interference between workpieces, or to eliminate stress concentration at the corner, or to prevent sharp corner from causing injury to personnel.

However, in a state where the workpiece is clamped by a fixture of the machining tool, it is difficult to chamfer the corner of the workpiece to be processed on the fixture side. To this end, it is necessary to carry out special design of fixtures and cutters to reserve machining positions, or increase machine tools, increase processes, and design another set of fixtures at the same time. As a result, the design cost of fixtures and cutters and the cost of product machining are virtually increased.

For example, FIG. 1A is an exploded perspective view of an orbiting scroll and a cross ring of a scroll compressor in the prior art. FIG. 1B is a longitudinal cross-sectional view of the orbiting scroll and the cross ring shown in FIG. 1A in an assembled state. FIG. 1C is an enlarged view of an area C shown in FIG. 1B.

Specifically, as shown in FIGS. 1A to 1C, the orbiting scroll 1 is configured to have a bottom plate 11 and a scroll 12. The bottom plate 11 is with an upper surface, a lower surface 112 and an outer peripheral surface. The scroll 12 is provided on the upper surface of the bottom plate 11. A hub 13 is provided on the lower surface of the bottom plate 11 for connecting with the eccentric shaft/crankshaft of the scroll compressor. A plurality of (e.g., three) bayonets 111 and two positioning slots 14 are provided on the outer peripheral surface of the bottom plate 11. These bayonets 111 can be clamped by the chuck of the machining tool, so that the machining tool can perform turning machining for the orbiting scroll 1. When viewed in the direction of the central axis of the orbiting scroll 1, each of the positioning slots 14 is generally "∟" shaped, and the two positioning slots 14 are arranged centrally symmetrically relative to the center of the orbiting scroll 1. Each of the positioning slots 14 comprises two radial vertical surfaces, a circumferential vertical surface 141 and an opening facing outwards in the radial direction of the orbiting scroll 1. In addition, the cross ring 2 is configured to have an annular body 21 and two positioning pins 22 arranged on the upper surface of the annular body 21. The two positioning pins 22 are centrally symmetrically arranged relative to the center of the cross ring 2. In a state where the orbiting scroll 1 is assembled to the cross ring 2, the lower surface 112 of the bottom plate 11 is slidably fitted on the upper surface of the annular body 21. At this time, each of the positioning pins 22 is inserted into a corresponding positioning slot 14, and the positioning pins 22 are slidable back and forth relative to the positioning slot 14 in the radial direction of the orbiting scroll 1, so that the orbiting scroll 1 is slidable back and forth relative to the cross ring 2 in the radial direction of the orbiting scroll 1, as indicated by the double-headed arrows MD in FIGS. 1A and 1B.

As shown in FIG. 1B and FIG. 1C, a circumferential vertical surface 141 of a positioning slot 14 may abut against the inner vertical surface 221 of the positioning pin 22 when the orbiting scroll 1 is moved to the left or right to the limit position. As an example, FIG. 1C shows a longitudinal cross-sectional view in a state in which the orbiting scroll 1 is moved to the right to the limit position. In order to avoid assembly interference between the workpieces, a chamfer 142 is formed on the edge formed by the intersection of the circumferential vertical surface 141 and the lower surface 112 of the bottom plate. Additionally, in order to avoid the assembly interference between the workpieces and eliminate the stress concentration at the corner, an inner fillet (or inner chamfer) 211 may be formed at the edge where the inner vertical surface 221 intersects with the upper surface of the annular body 21 of the cross ring 2.

FIG. 2 is a schematic diagram of a prior art process for milling a chamfer on an orbiting scroll as shown in FIGS. 1A to 1C.

As shown in FIG. 2, in order to machine the chamfer 142, the orbiting scroll 1 needs to be clamped on the fixture 3 first, and then the milling tool 4 is used to machine the orbiting scroll 1. Specifically, the fixture 3 comprises a base 31 and a chuck 32. A plurality of clamping claws 33 are provided on the chuck 32. Each of the clamping claws 33 can clamp a corresponding one of the bayonets 111 on the outer peripheral surface of the bottom plate 11 of the orbiting scroll 1, thereby clamping the orbiting scroll 1 on the fixture 3. It can be seen that, due to the restriction of the respective structures of the fixture 3 and the orbiting scroll 1, in the state where the orbiting scroll 1 is clamped by the fixture 3, the scroll 12 of the orbiting scroll 1 is located outside while the bottom plate 11 of the orbiting scroll 1 is located inside. As a result, it is difficult to machine the chamfer 142 due to the blocking of the chuck 32. Therefore, a plurality of machining holes (or grooves) 34, 35 are reserved on the fixture 3 for machining the orbiting scroll 1 with the milling tool 4. Furthermore, the shank of the milling tool 4 is designed to have a long length and high strength, so that milling operations such as chamfering can be performed through the machining holes 34, 35.

It can be found that opening holes (or grooves) on the fixture 3 will lead to increased fixture production and maintenance costs. If a longer shank is used, the price of the cutter will be high, and the vibration of the cutter will make the machining quality worse. In order to ensure the machining quality, it is necessary to reduce the machining speed, which results in prolonged machining time.

SUMMARY

Technical Problem

The present disclosure has been made in order to solve the above technical problems and potential other technical problems.

Technical Solution

As we all know, the cost of milling is generally higher than that of turning. Therefore, the design idea of the present disclosure is that the annular groove processed by turning is used to replace the chamfering processed by milling on the premise of realizing the same product function. In this way, the design cost and the use cost of the fixture and the cutter can be reduced, the machining cycle can be reduced, and the machining efficiency can be improved.

In one aspect, there is a scroll assembly adapted for a scroll compressor provided in the present disclosure. The scroll assembly comprises an orbiting scroll and a cross ring. The orbiting scroll is configured to have a bottom plate and a scroll. The bottom plate is with an upper surface, a lower surface and an outer peripheral surface. The scroll is provided on the upper surface of the bottom plate. A plurality of bayonets and two positioning slots are provided on the outer peripheral surface of the bottom plate. These bayonets are adapted to be clamped by a chuck of a turning tool for turning the orbiting scroll by the turning tool. Each of two positioning slots is generally "L" shaped and the two positioning slots are arranged centrally symmetrically relative to the center of the orbiting scroll when viewed in the direction of the central axis of the orbiting scroll. Each of the positioning slots comprises two radial vertical surfaces, a circumferential vertical surface and an opening facing outwards in the radial direction of the orbiting scroll. The cross ring is configured to have an annular body and two positioning pins provided on the upper surface of the annular body. The two positioning pins are centrally symmetrically arranged relative to the center of the cross ring. In the state where the orbiting scroll is assembled to the cross ring, the lower surface of the bottom plate is slidably fitted on the upper surface of the annular body, each of the positioning pins is inserted into a corresponding positioning slot. The positioning pins can slide back and forth relative to the positioning slot in the radial direction of the orbiting scroll, so that the orbiting scroll can slide back and forth relative to the cross ring in the radial direction of the orbiting scroll. An annular groove adapted for being formed by turning is provided on the lower surface of the bottom plate of the orbiting scroll, and the annular groove is sized such that a chamfer is formed on the edge of the annular groove formed by the intersection of the circumferential vertical surface of a positioning slot and the lower surface of the bottom plate. The sizes of the annular groove comprise the diameter of the neutral circle of the annular groove, the depth of the annular groove, the size of the opening of the annular groove, and the like.

Optionally, the diameter of the neutral circle of the annular groove is greater than the distance between the circumferential vertical surfaces of the two positioning slots in the radial direction of the orbiting scroll. The cross-sectional profile of the annular groove may be "A" shaped. The chamfer may be a 45° chamfer, or it may be a non-45° chamfer.

Additionally, a positioning pin is configured to have a vertical surface opposite to the circumferential vertical surface of a positioning slot. An inner fillet or inner chamfer may be formed at the edge where the vertical surface of a positioning pin intersects with the upper surface of the annular body. The radius of the inner fillet is less than or equal to the length of the right-angled side of the chamfer.

In another aspect, the present disclosure provides a scroll compressor comprising the scroll assembly according to the previous one aspect.

Technical Effect

In the technical solution of the present disclosure, the annular groove does not affect the function of the orbiting scroll, and can play the role of chamfering at the same time. In this way, the use of a milling tool and fixture for chamfering can be avoided. Alternatively, an annular groove is machined in the orbiting scroll using a turning tool and fixture. As a result, under the premise of realizing the same product function, the manufacturing and maintenance costs of the machining tool are reduced, and the machining quality and efficiency are improved.

BRIEF DESCRIPTION OF THE DRAWINGS

In order to facilitate understanding of the present disclosure, the present disclosure is hereinafter described in more detail based on exemplary embodiments in conjunction with the accompanying drawings. The same or similar reference numbers are used in the accompanying drawings to refer to the same or similar components. It should be understood that the accompanying drawings are only schematic and the sizes and proportions of the components in the accompanying drawings are not necessarily accurate.

DETAILED DESCRIPTION

Figure 1A:
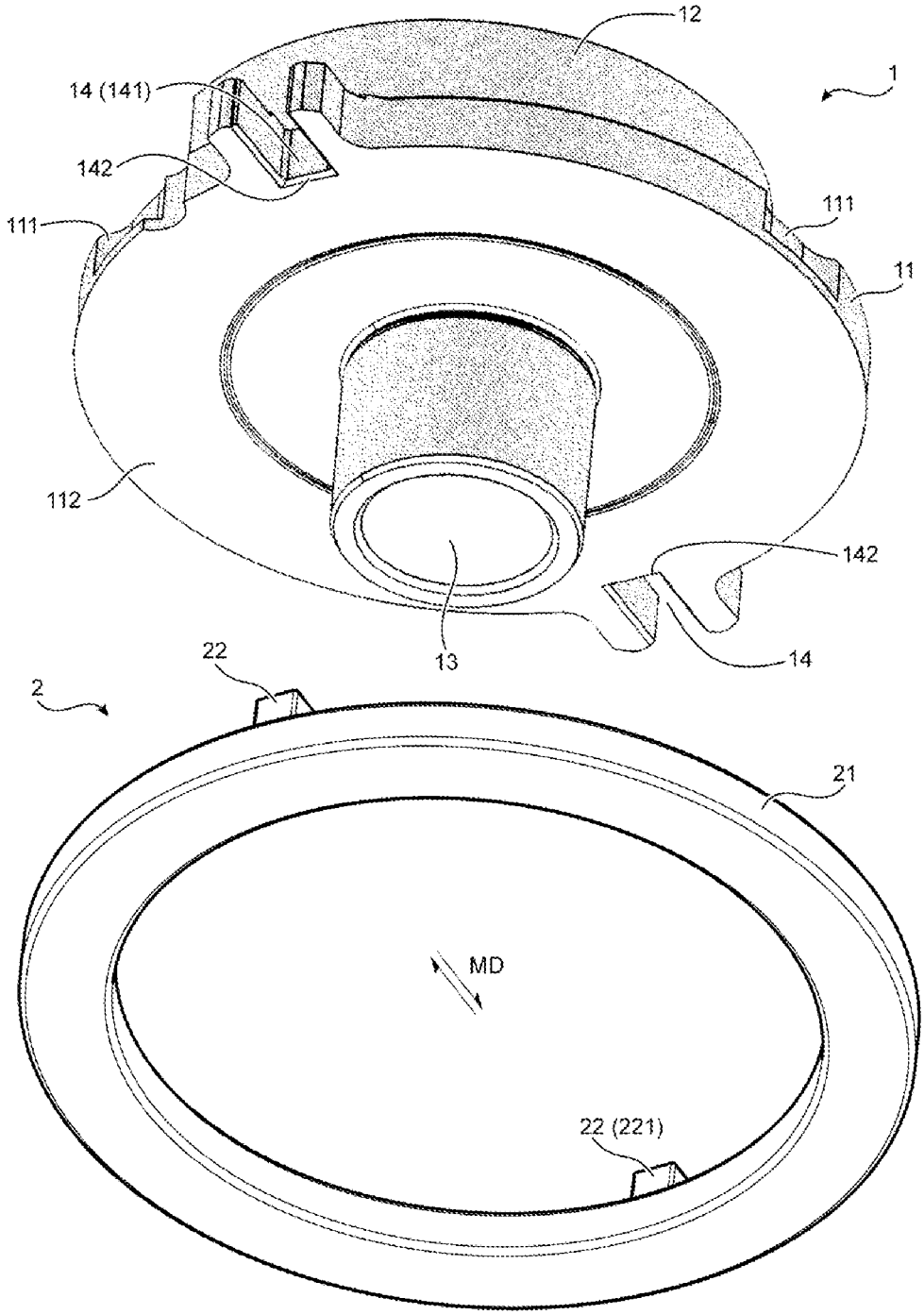
FIG. 1A Prior Art
FIG. 1A is an exploded perspective view of an orbiting scroll and a cross ring of a scroll compressor in the prior art.
Figure 1B:
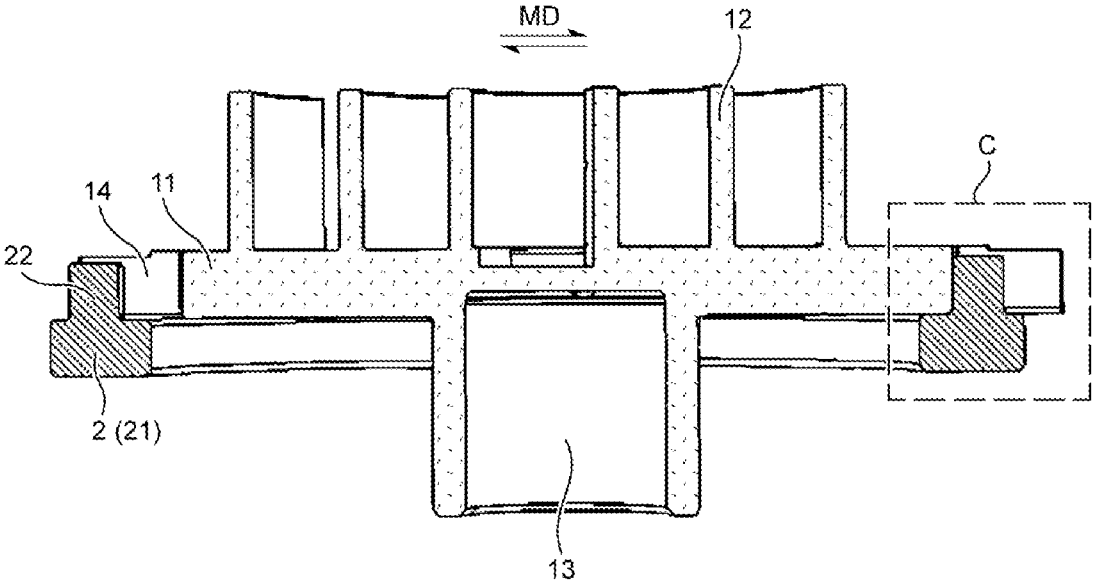
FIG. 1B Prior Art
FIG. 1B is a longitudinal cross-sectional view of the orbiting scroll and the cross ring shown in FIG. 1A in an assembled state.
Figure 1C:
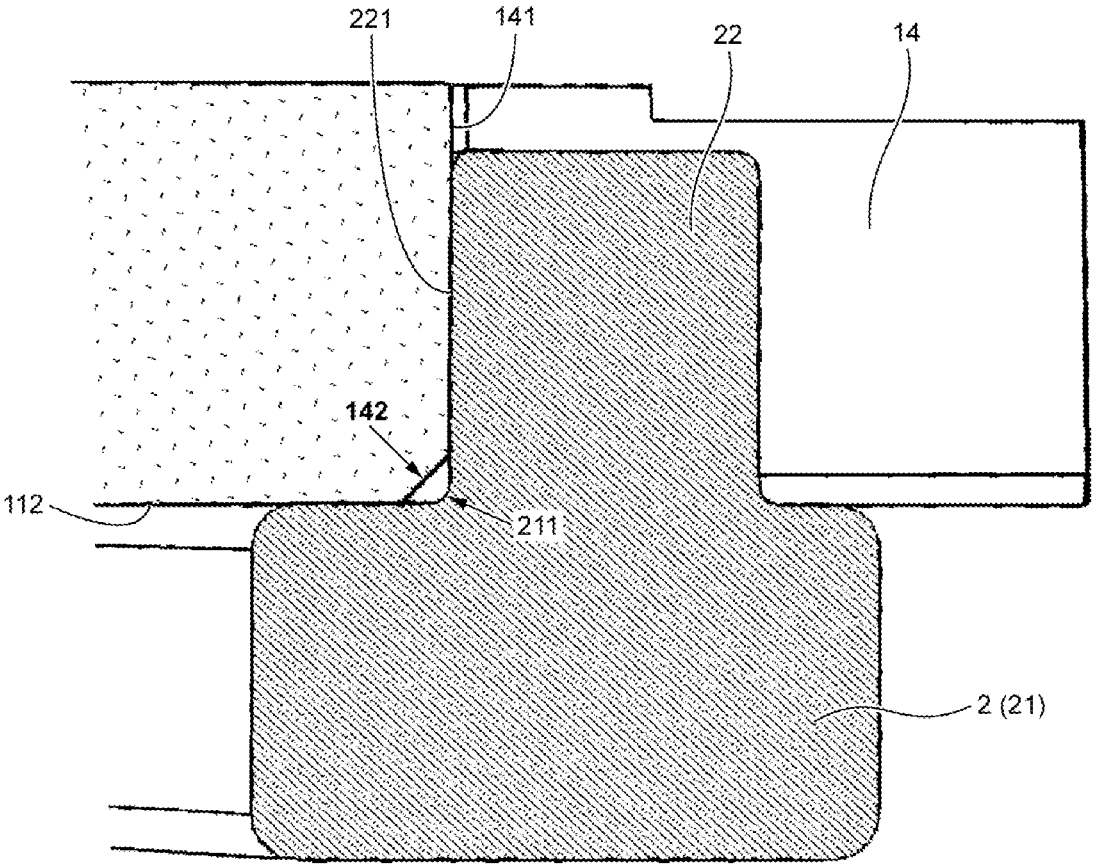
FIG. 1C Prior Art
FIG. 1C is an enlarged view of an area C shown in FIG. 1B.
Figure 2:
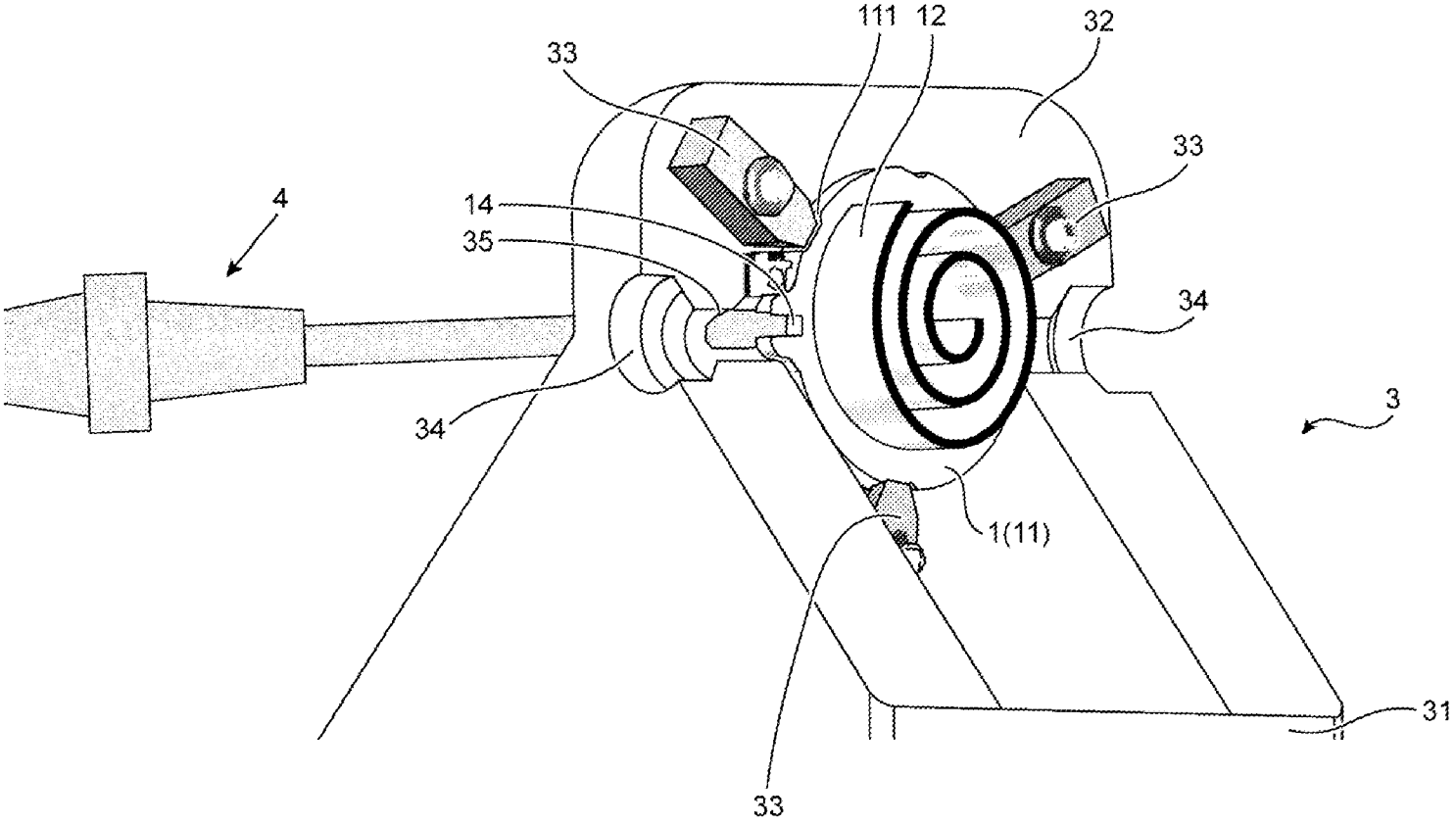
FIG. 2 Prior Art
FIG. 2 is a schematic diagram of a prior art process for milling a chamfer on an orbiting scroll as shown in FIGS. 1A to 1C.

A construction of a scroll assembly and a machining scheme for the scroll assembly in the prior art have been described in "BACKGROUND" with reference to FIGS. 1A-2. In the following, a construction and machining scheme according to the present disclosure will be described with reference to FIGS. 3A, 3B and 4.

Figure 3A:
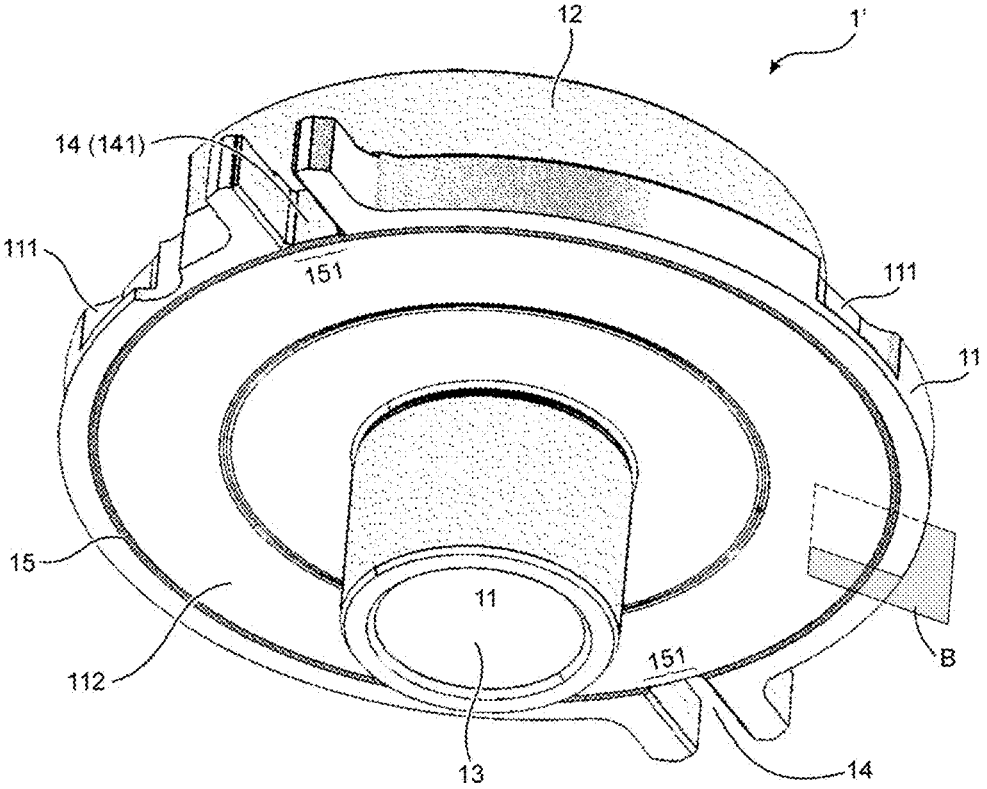
FIG. 3A is a perspective view of an orbiting scroll according to an exemplary embodiment of the present disclosure.
Figure 3B:
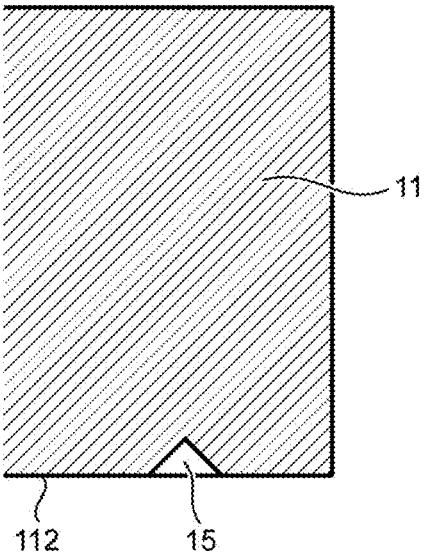
FIG. 3B is a partial cross-sectional view taken along a cutting plane B shown in FIG. 3A.

FIG. 3A is a perspective view of an orbiting scroll according to an exemplary embodiment of the present disclosure. FIG. 3B is a partial cross-sectional view taken along a cutting plane B shown in FIG. 3A, wherein the cutting plane B is a plane passing through the central axis of the orbiting scroll.

Specifically, as shown in FIG. 3A and FIG. 3B, the orbiting scroll 1' according to the exemplary embodiment of the present disclosure has substantially the same construction as the orbiting scroll 1 in the prior art described above, so the existing construction of the orbiting scroll 1' will not be described again. The orbiting scroll 1' of the present disclosure differs from the prior art in the following aspects (that is, the points in which the design idea of the present disclosure is embodied):

An annular groove 15 adapted for being formed by turning is provided on the lower surface 112 of the bottom plate 11 of the orbiting scroll 1' of the present disclosure. A chamfer 151 is formed by a section of the annular groove 15 on the edge formed by the intersection of the circumferential vertical surface 141 of a positioning slot and the lower surface 112 of the bottom plate. In this way, the chamfer 141 formed by milling in the prior art can be replaced by the chamfer 151 formed by turning. That is to say, the section 151 of the annular groove 15 located on the edge formed by the intersection of the circumferential vertical surface 141 and the lower surface 112 can play the role of chamfering, while the remaining sections of the annular groove 15 do not affect the function of the orbiting scroll 1'.

In this way, the use of a milling tool and fixture for chamfering can be avoided. As a result, under the premise of realizing the same product function, the manufacturing and maintenance costs of the machining tool are reduced, and the machining quality and efficiency are improved. Taking the chamfer 151 of the orbiting scroll 1' of the present disclosure as an example, the inventor learned through calculation that 49 seconds of machining time can be saved for a single piece compared to the existing milling machining scheme.

As shown in FIG. 3B, a cross section of the annular groove 15 is taken when the scroll surface of the orbiting scroll faces upwards, and the cross-sectional profile of the annular groove 15 may be "Λ" shaped. Specifically, the size of the annular groove 15 is set such that a chamfer 151 is formed on the edge of the annular groove 15 formed by the intersection of the circumferential vertical surface 141 of the positioning slot and the lower surface 112 of the bottom plate. The sizes of the annular groove 15 comprise the diameter of the neutral circle of the annular groove 15, the depth of the annular groove 15, the size of the opening of the annular groove 15, and the like. It should be understood that the diameter of the neutral circle of the annular groove 15 is equal to ½ of the sum of the diameter of the outer circumference of the annular groove 15 and the diameter of the inner circumference of the annular groove 15.

Optionally, the diameter of the neutral circle of the annular groove 15 is greater than the distance between the circumferential vertical surfaces 141 of the two positioning slots 14 in the radial direction of the orbiting scroll 1', and the depth and the size of the opening of the annular groove 15 can ensure the edge formed by the intersection of the circumferential vertical surface 141 of a positioning slot and the lower surface 112 of the bottom plate is turned to form a chamfer 151. The chamfer 151 may be a 45° chamfer or a non-45° chamfer.

Figure 4:
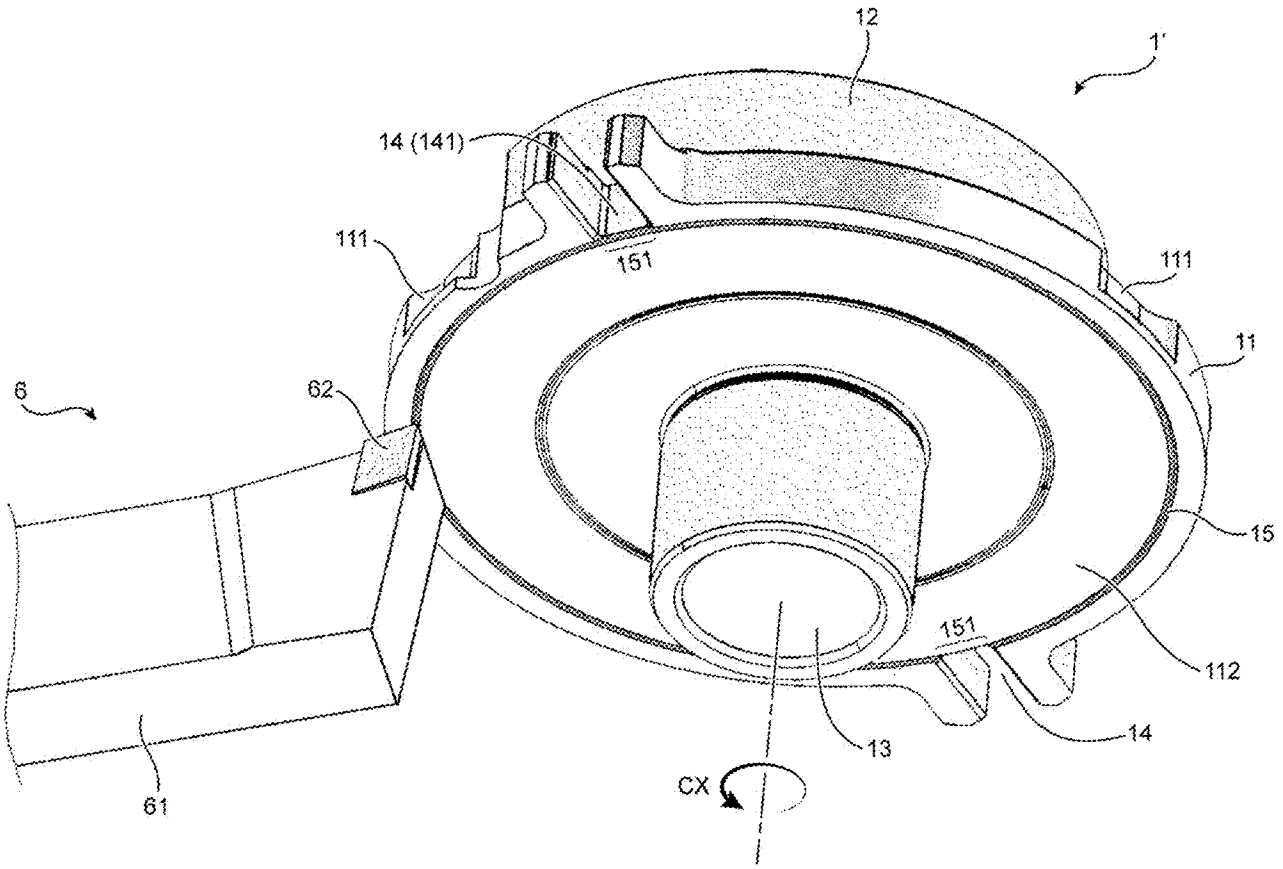
FIG. 4 is a schematic diagram of a process for turning a chamfer on the orbiting scroll as shown in FIG. 3A.

FIG. 4 is a schematic diagram of a process for turning a chamfer on the orbiting scroll as shown in FIG. 3A.

As shown in FIG. 4, the orbiting scroll 1' is clamped by a chuck (not shown) of a turning tool and is rotated in the CX direction around its own central axis. The turning tool 6 comprises a tool body 61 and a tool tip 62. The tool tip 62 of the turning tool 6 turns the lower surface 112 of the bottom plate of the orbiting scroll 1' when the orbiting scroll 1' is rotated, whereby the annular groove 15 can be formed by turning. By appropriately setting/adjusting parameters such as the feed amount of the turning tool 6, the attitude of the turning tool, and the shape of the tool tip, the desired chamfer 151 can be finally obtained.

Figure 5:
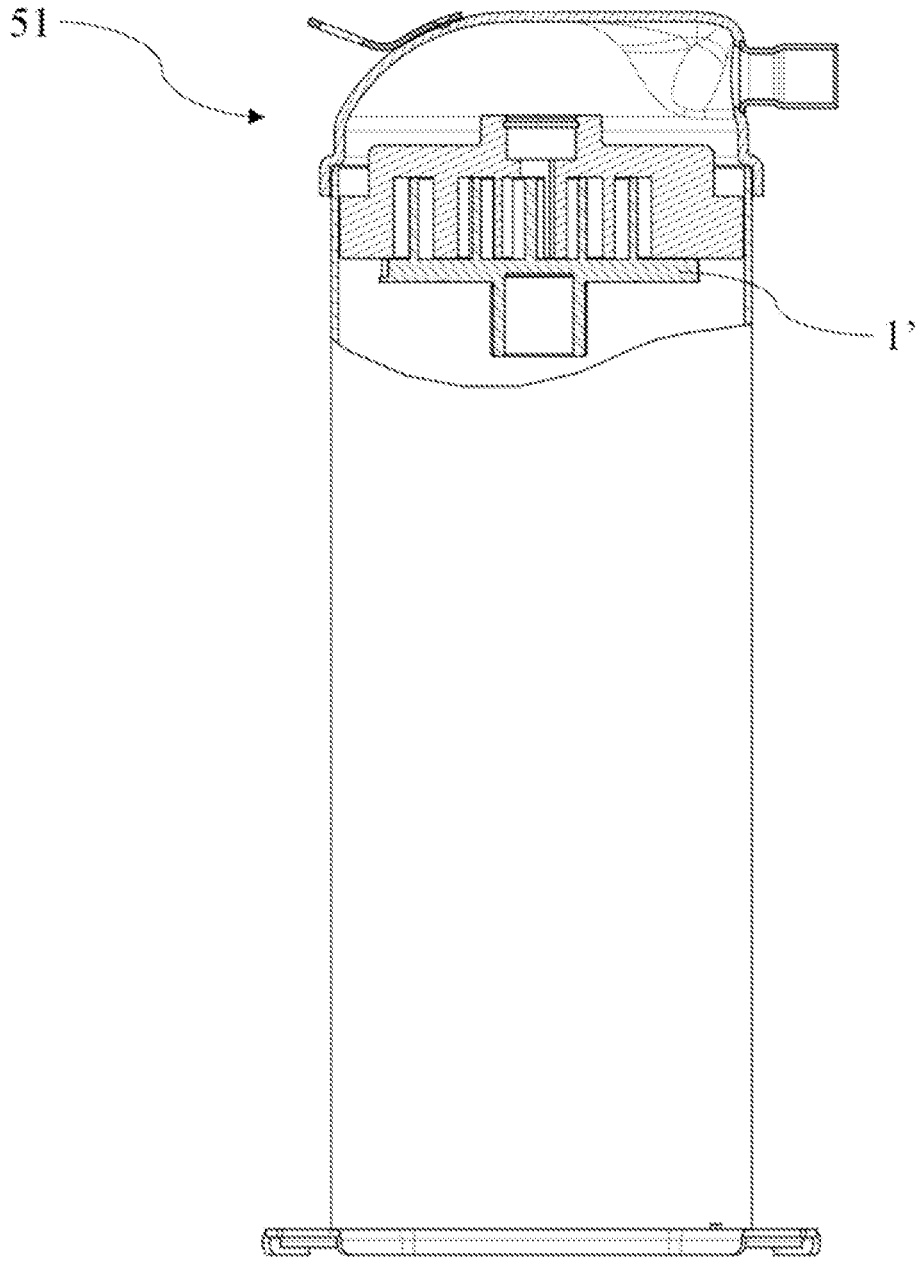
FIG. 5 is a partial longitudinal cross-section view of a scroll compressor according to an exemplary embodiment of the present disclosure.

FIG. 5 is a partial longitudinal cross-section view of a scroll compressor according to an exemplary embodiment of the present disclosure. As shown in FIG. 5, the scroll assembly including the orbiting scroll 1' according to the exemplary embodiment of the present disclosure is provided in the scroll compressor 51.

Although the technical object, technical solution and technical effect of the present disclosure have been described in detail above with reference to specific embodiments, it should be understood that the above-mentioned embodiments are only exemplary rather than restrictive. Within the essential spirit and principle of the present disclosure, any modifications, equivalent replacements, and improvements made by those skilled in the art are included within the protection scope of the present disclosure. For example, the chamfering machining solution in the present disclosure can also be applied to other applicable situations, and is not limited to the chamfering machining process of the positioning slots of the orbiting scroll of the scroll compressor.

What is claimed is:

1. A scroll assembly adapted for a scroll compressor, comprising:

an orbiting scroll configured to have a bottom plate with an upper surface, a lower surface and an outer peripheral surface, and a scroll arranged on the upper surface of the bottom plate, and the outer peripheral surface of the bottom plate being provided with:

a plurality of bayonets adapted to be clamped by a chuck of a turning tool for turning the orbiting scroll by the turning tool; and two positioning slots, each of which being generally "⌐" shaped and the two positioning slots being arranged centrally symmetrically relative to a center of the orbiting scroll when viewed in the direction of a central axis of the orbiting scroll, wherein each of the positioning slots comprises two radial vertical surfaces, a circumferential vertical surface and an opening facing outwards in a radial direction of the orbiting scroll; and a cross ring configured to have an annular body and two positioning pins provided on an upper surface of the annular body, the two positioning pins being centrally symmetrically arranged relative to a center of the cross ring, wherein in the state where the orbiting scroll is assembled to the cross ring, the lower surface of the bottom plate is slidably fitted on the upper surface of the annular body, each of the positioning pins is inserted into a corresponding positioning slot, and the positioning pins are slidable back and forth respectively relative to the corresponding positioning slots in the radial direction of the orbiting scroll, so that the orbiting scroll is slidable back and forth relative to the cross ring in the radial direction of the orbiting scroll, wherein an annular groove adapted for being formed by turning is provided on the lower surface of the bottom plate of the orbiting scroll, and the annular groove is sized such that a chamfer is formed on an edge of the annular groove formed by the intersection of the circumferential vertical surface of the corresponding positioning slot and the lower surface of the bottom plate.

2. The scroll assembly according to claim 1, wherein a diameter of the neutral circle of the annular groove is greater than a distance between the circumferential vertical surfaces of the two positioning slots in the radial direction of the orbiting scroll.

3. The scroll assembly according to claim 2, wherein a cross-sectional profile of the annular groove is "Λ" shaped.

4. A scroll compressor, wherein the scroll compressor comprises the scroll assembly according to claim 2.

5. The scroll assembly according to claim 1, wherein a cross-sectional profile of the annular groove is "Λ" shaped.

6. A scroll compressor, wherein the scroll compressor comprises the scroll assembly according to claim 5.

7. The scroll assembly according to claim 1, wherein the chamfer is a 45° chamfer or a non-45° chamfer.

8. The scroll assembly according to claim 7, wherein each of the two positioning pins is configured to have a vertical surface opposite to the circumferential vertical surface of the corresponding positioning slot, and an inner fillet is formed at the edge where the vertical surface of each of the two positioning pins intersects with the upper surface of the annular body.

9. The scroll assembly according to claim 8, wherein a radius of the inner fillet is less than or equal to a length of the right-angled side of the chamfer.

10. A scroll compressor, wherein the scroll compressor comprises the scroll assembly according to claim 9.

11. A scroll compressor, wherein the scroll compressor comprises the scroll assembly according to claim 8.

12. A scroll compressor, wherein the scroll compressor comprises the scroll assembly according to claim 7.

13. A scroll compressor, wherein the scroll compressor comprises the scroll assembly according to claim 1.

* * * * *